US009377004B2

(12) United States Patent
Ikeda

(10) Patent No.: US 9,377,004 B2
(45) Date of Patent: Jun. 28, 2016

(54) PLASMA GENERATION APPARATUS

(71) Applicant: IMAGINEERING, INC., Kobe (JP)

(72) Inventor: Yuji Ikeda, Kobe (JP)

(73) Assignee: IMAGINEERING, INC., Kobe (JP)

( * ) Notice: Subject to any disclaimer, the term of this patent is extended or adjusted under 35 U.S.C. 154(b) by 0 days.

(21) Appl. No.: 14/631,142

(22) Filed: Feb. 25, 2015

(65) Prior Publication Data

US 2015/0167625 A1 Jun. 18, 2015

Related U.S. Application Data

(63) Continuation-in-part of application No. PCT/JP2013/072990, filed on Jun. 17, 2013.

(51) Int. Cl.

| | |
|---|---|
| ***H05H 1/46*** | (2006.01) |
| ***F02P 23/04*** | (2006.01) |
| ***F02P 3/01*** | (2006.01) |
| ***F02P 9/00*** | (2006.01) |
| ***F02M 27/08*** | (2006.01) |

(52) U.S. Cl.

CPC ..... *F02P 23/045* (2013.01); *F02M 27/08* (2013.01); *F02P 3/01* (2013.01); *F02P 9/007* (2013.01); *H05H 1/46* (2013.01); *H05H 2001/463* (2013.01); *H05H 2001/466* (2013.01); *H05H 2001/4682* (2013.01)

(58) Field of Classification Search

USPC ..... 315/34; 123/143 R, 143 A, 143 B, 143 C

See application file for complete search history.

(56) References Cited

U.S. PATENT DOCUMENTS

| | | | | |
|---|---|---|---|---|
| 2009/0229581 | A1* | 9/2009 | Ikeda | 123/536 |
| 2013/0049593 | A1* | 2/2013 | Sugino et al. | 315/111.41 |

FOREIGN PATENT DOCUMENTS

| | | | | |
|---|---|---|---|---|
| JP | 2011-96109 | A | | 4/2010 |
| JP | 2013-113184 | A | | 6/2013 |
| WO | 2008-035448 | A1 | | 3/2008 |
| WO | WO 2011034189 | | * | 3/2011 |
| WO | 2011-043399 | A1 | | 4/2011 |
| WO | WO 2011043399 | | * | 4/2011 |
| WO | 2011-152493 | A1 | | 12/2011 |
| WO | 2012-105568 | A2 | | 8/2012 |
| WO | 2012-105571 | A2 | | 8/2012 |
| WO | 2012-111701 | A2 | | 8/2012 |

OTHER PUBLICATIONS

International Search Report dated Dec. 17, 2013 issued in corresponding application No. PCT/JP2013/072990.

* cited by examiner

*Primary Examiner* — Thuy Vinh Tran
*Assistant Examiner* — Jonathan Cooper
(74) *Attorney, Agent, or Firm* — Bacon & Thomas, PLLC

(57) ABSTRACT

The present invention addresses the issue of improving generation efficiency of plasma in relation to usage power in a plasma generation apparatus. The present invention is directed to a plasma generation apparatus provided with an electromagnetic wave emission antenna and a discharge electrode. The plasma generation apparatus includes a plasma control device that controls generation of plasma, and is characterized that the plasma control device causes the electromagnetic wave emission antenna to intermittently emit electromagnetic waves by way of a drive sequence control. Especially, the plasma control device may preferably control an oscillating frequency, a power, output timing, a pulse width, a pulse cycle, and a duty cycle of the electromagnetic waves.

2 Claims, 5 Drawing Sheets

Controlled Items

A : Microwave Output
B : Pulse Width
C : Pulse Cycle
D : Burst Pulse Cycle
E : Burst Pulse Width
F : Delay Time from Trigger Signal

PLASMA GENERATION APPARATUS

TECHNICAL FIELD

The present invention relates to a plasma generation apparatus.

BACKGROUND ART

Conventionally, there is developed a plasma generation apparatus using electromagnetic waves. For example, Japanese Unexamined Patent Application, Publication No. 2007-113570 discloses an ignition device employing a plasma generation apparatus that causes plasma discharge to occur by emitting microwaves to a combustion chamber in an internal combustion engine or the like before and/or after ignition of air fuel mixture. In the plasma generation apparatus, local plasma can be generated utilizing a discharge at an ignition plug, and can enhance this plasma using microwaves.

However, in the conventional plasma generation apparatus, there is a disadvantage that generation efficiency of the plasma is not sufficient in relation to usage power.

SUMMARY OF INVENTION

The plasma generation apparatus according to one aspect of the present invention includes an electromagnetic wave emission antenna; and a discharge electrode, wherein the plasma generation apparatus includes a plasma control device that controls generation of plasma, and the plasma control device causes the electromagnetic wave emission antenna to intermittently emit electromagnetic waves by way of a drive sequence control.

With the above plasma generation apparatus, intermittent electromagnetic waves can be emitted under a control of the plasma control device. This allows an emission of the electromagnetic waves having an appropriate pulse width and can stop emitting the electromagnetic waves during a period equivalent to a life period of radicals generated by the emission. By repeating this generation-intermission cycle, usage power can be reduced and plasma generation efficiency in relation to usage power is thereby improved.

The plasma control device may control an oscillating frequency, a power, output timing, the pulse width, a pulse cycle, and a duty cycle of the electromagnetic waves.

With the above plasma generation apparatus present invention, the oscillating frequency, the power, the output timing, the pulse width, the pulse cycle, and the duty cycle of the electromagnetic waves can be controlled by the plasma control device. This allows an efficient generation of the plasma using the electromagnetic waves with intensity and a frequency (or repetition) which suits the purpose or condition.

The plasma generation apparatus according to the present invention may be provided with a plurality of the electromagnetic wave emission antennae. Since the plasma generation apparatus is provided with the plurality of the electromagnetic wave emission antennae, an intensity of the plasma can be improved efficiently in a generation region of the plasma. Also, the plasma can be generated at a desired location in the plasma generation region upon requirements.

The plasma control device may be subject to a programmed control in accordance with the generation efficiency of the plasma.

With the above plasma generation apparatus, since the plasma control device is subject to a programmed control in accordance with the plasma generation efficiency in the plasma generation region, when the plasma generation efficiency is low, the electromagnetic wave emission can be controlled so that the plasma generation efficiency is increased, and conversely, when the plasma generation efficiency is sufficiently high, the electromagnetic wave emission can be controlled so that a condition of the emission is maintained. As a result of this, the plasma generation efficiency can be improved sufficiently in relation to usage power.

The plasma control device may be subject to a feedback control in accordance with the generation efficiency of the plasma.

With the above plasma generation apparatus, since the plasma control device is subject to a feedback control in accordance with the plasma generation efficiency in the plasma generation region, in a case in which the plasma generation efficiency is low, the plasma control device may respond in real time, select an emitting condition for increasing the plasma generation efficiency, and perform the condition. Conversely, in a case in which the plasma generation efficiency is sufficiently high, the plasma control device may control in real time the electromagnetic wave emission so as to maintain the emitting condition. As a result, the plasma generation efficiency can be improved sufficiently in relation to usage power.

The generation efficiency of the plasma may be represented by at least one index value selected from among a group of indexes including a radical light emission amount, a temperature, an electron temperature, and a reflected wave power.

An intensity of the plasma in the plasma generation region can be represented using the radical light emission amount, the temperature, the electron temperature, or the reflected wave power as indexes. Accordingly, in the above plasma generation apparatus, the plasma generation can be controlled much appropriate and precisely because the plasma control device is controlled by the radical light emission amount, the temperature, the electron temperature, and the reflected wave power as the plasma generation efficiency. As a result, the plasma generation efficiency can be improved.

The plasma generation apparatus according to the present invention can be applied to an internal combustion engine. By applying the above plasma generation apparatus to the internal combustion engine, combustion efficiency of an air fuel mixture in a vehicle engine or the like can be improved, and fuel consumption is thereby improved.

In this case, the plasma control device may preferably perform a control during a cold start of the internal combustion engine so as to limit fuel injection and emit the electromagnetic wave for raising the temperature in the vicinity of a discharge device of the internal combustion engine. By irradiating the vicinity of the discharge device with the electromagnetic wave during the cold start so as to heat residual moisture in the combustion chamber, the temperature in the vicinity of the discharge device can be raised and ignitability during the cold start can be improved.

DETAILED DESCRIPTION

In the following, a detailed description will be given of an embodiment of the present invention with reference to the accompanying drawings. It should be noted that the following embodiments are merely preferable examples, and do not limit the scope of the present invention, applied field thereof, or application thereof.

Figure 1:
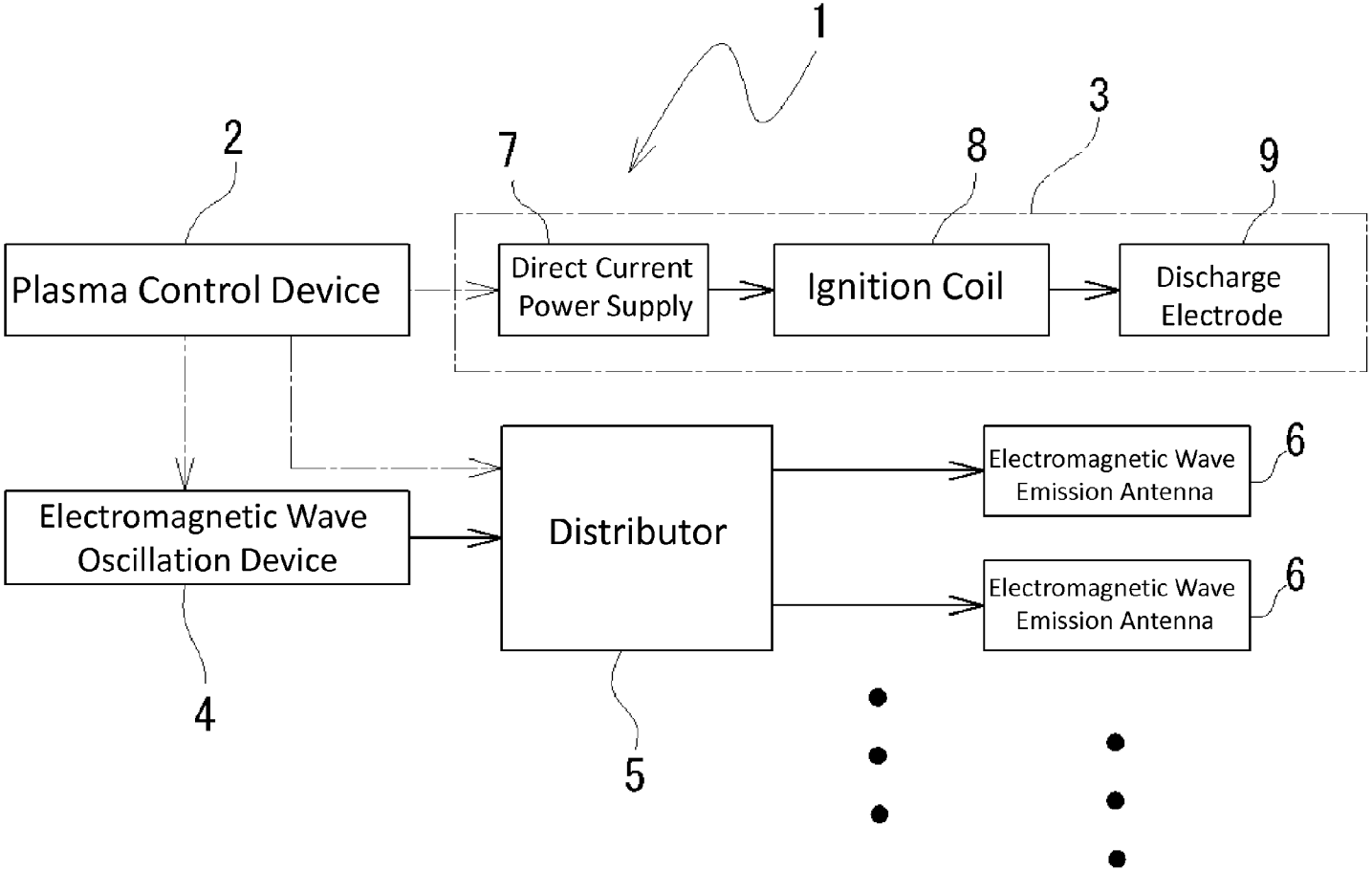
FIG. 1 is a block diagram of a plasma generation apparatus according to an embodiment.

The present embodiment is directed to a plasma generation apparatus according to the present invention. As shown in FIG. 1, the plasma generation apparatus 1 according to the present embodiment is provided with a plasma control device 2, a discharge device 3, an electromagnetic wave oscillation device 4, a distributor 5, and an electromagnetic wave emission antenna 6. The discharge device 3 includes a direct current power supply 7, an ignition coil 8, and a discharge electrode 9. The plasma generation apparatus 1 according to the present embodiment causes discharge plasma to occur at the discharge electrode 9, and causes the electromagnetic wave emission antenna 6 to emit a microwave, thereby it is possible to enlarge and maintain the discharge plasma.

The discharge device 3 includes the direct current power supply 7, the ignition coil 8, and the discharge electrode 9. The ignition coil 8 is electrically connected to the direct current power supply 7 such as a vehicle battery.

The ignition coil 8, upon receiving an ignition signal from the plasma control device 2, boosts a voltage applied from the direct current power supply 7. The boosted high voltage pulse is supplied to the discharge electrode 9.

The discharge electrode 9 is, for example, an ignition plug for a vehicle, and includes a central electrode and a ground electrode. When the high voltage pulse is supplied to the discharge electrode 9, insulation breakdown occurs at a discharge gap between the central electrode and the ground electrode, and discharge plasma (spark discharge) is generated.

Figure 2:
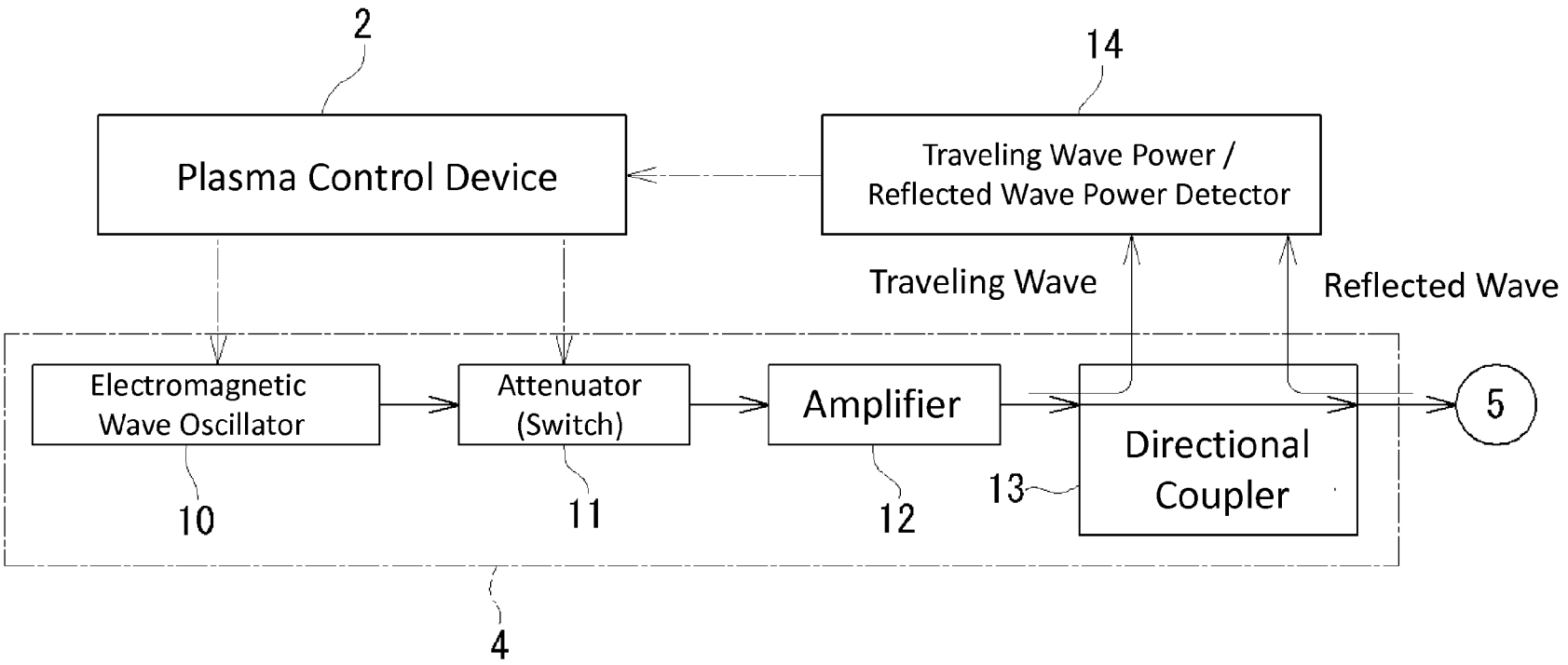
FIG. 2 is a block diagram of an electromagnetic wave oscillation device provided for the plasma generation apparatus according to the embodiment.

As shown in FIG. 2, the electromagnetic wave oscillation device 4 includes an electromagnetic wave oscillator 10, an attenuator/switch 11, an amplifier 12, and a directional coupler 13. A traveling wave power and reflected wave power detector 14 is disposed between the directional coupler 13 and the plasma control device 2.

The electromagnetic wave oscillator 10 is a semiconductor oscillator. The electromagnetic wave oscillator 10, upon receiving an electromagnetic wave drive signal from the plasma control device 2, outputs the microwave of a predetermined pulse width at a predetermined duty cycle. As the electromagnetic wave oscillator 10, a magnetron may be employed.

The attenuator/switch 11, upon receiving an output control signal from the plasma control device 2, adjusts the intensity of the microwave oscillated from the electromagnetic wave oscillator 10, and outputs the microwave thus adjusted.

The amplifier 12 amplifies the microwave outputted from the electromagnetic wave oscillator 10. The amplifier 12 may be configured in two stages of a driver amplifier and a final amplifier, and may be configured in one stage as long as a desired output can be acquired.

The directional coupler 13 simultaneously acquires signals respectively corresponding to a traveling wave power from the electromagnetic wave oscillator 10 and a reflected wave power from the electromagnetic wave emission antenna 6. The traveling wave power and reflected wave power detector 14 detects the traveling wave power and the reflected wave power, and provides the information to the plasma control device 2.

The distributor 5 distributes the microwave outputted from the electromagnetic wave oscillator 10 to each antenna from among a plurality of the electromagnetic wave emission antennae 6. In a case in which a specific antenna is exclusively selected to emit the microwave, the distributor 5 switches so that the specific antenna should exclusively be supplied with the microwave. The distributor 5 operates under a control of the plasma control device 2.

The plasma control device 2 determines an optimal oscillating frequency from the detection result received from the traveling wave power and reflected wave power detector 14, and provides an instruction signal to the electromagnetic wave oscillator 10. Also, the plasma control device 2 provides the ignition signal to the direct current power supply 7 of the discharge device 3 at appropriate discharge timing. Furthermore, the plasma control device 2 provides to the attenuator/switch 11 an instruction signal indicative of an output level and turn-on or turn-off of the output.

Operation of Plasma Generation Apparatus

An operation of the plasma generation apparatus 1 will be described hereinafter.

The plasma control device 2 outputs the ignition signal to the direct current power supply 7 of the discharge device 3. As a result of this, the high voltage pulse outputted from the ignition coil 8 is supplied to the discharge electrode 9. Accordingly, discharge plasma is generated at the discharge gap of the discharge electrode 9.

Furthermore, immediately after the ignition coil 8 outputs the high voltage pulse, the plasma control device 2 sends the electromagnetic wave drive signal to the electromagnetic wave oscillator 10 of the electromagnetic wave oscillation device 4. In response to the electromagnetic wave drive signal, the electromagnetic wave oscillator 10 outputs the microwave. Prior to the output of the electromagnetic wave drive signal, the distributor 5 performs a switch operation such that an appropriate electromagnetic wave emission antenna 6 should become the supply destination of the microwave.

The microwave outputted from the electromagnetic wave oscillator 10 is adjusted by the attenuator/switch 11 in intensity, controlled to be ON or OFF as needed, and amplified by the amplifier 12 up to a predetermined intensity. And then, the microwave is emitted from the electromagnetic wave emission antenna 6 via the directional coupler 13 and the distributor 5. As a result of this, the discharge plasma is supplied with energy, and the non-equilibrium plasma is maintained and enlarged. The directional coupler 13 simultaneously acquires signals respectively corresponding to the traveling wave power from the electromagnetic wave oscillator 10 and the reflected wave power from the electromagnetic wave emission antenna 6. The traveling wave power and reflected wave power detector 14 detects the traveling wave power and the reflected wave power, and provides the information to the plasma control device 2. Based on the information, the plasma control device 2 performs a programmed control or a feedback control in relation to subsequent discharges and microwave emissions. The plasma control device 2 may perform the programmed control or the feedback control as described above, and may perform a control in accordance with a predetermined control pattern.

As described above, the plasma generation apparatus 1 according to the present embodiment detects the traveling wave power and the reflected wave power, and provides the information to the plasma control device 2 so as to perform the programmed control or the feedback control. Here, the above described information is not limited to the traveling wave power and the reflected wave power. The plasma control device 2 is subject to the programmed control and/or the feedback control based on the plasma generation efficiency in the plasma generation region. The plasma generation efficiency may be represented by any other value as long as the value can indicate the amount of plasma generation in relation to output power, and may be represented by parameters closely related to radical intensity such as a radical light emission amount, a field temperature, and an electromagnetic density.

With the plasma generation apparatus 1 according to the present embodiment, in a case in which the reflected wave power has a higher value in relation to the traveling wave power (i.e., the plasma generation efficiency is low), the plasma control device 2 may control an oscillation condition of the electromagnetic wave so as to decrease the value. Conversely, in a case in which the value is low (i.e., the plasma generation efficiency is sufficiently high), the plasma control device 2 may control the electromagnetic wave oscillation so as to maintain the oscillation condition. As a result of this, it becomes possible to sufficiently improve the plasma generation efficiency in relation to usage power.

With the plasma generation apparatus 1 according to the present embodiment, in a case in which the reflected wave power has a higher value in relation to the traveling wave power (i.e., the plasma generation efficiency is low), the plasma control device 2 may respond in real time, select an emitting condition for increasing the plasma generation efficiency, and perform the condition. Conversely, in a case in which the value is low (i.e., the plasma generation efficiency is sufficiently high), the plasma control device 2 may control the electromagnetic wave emission in real time so as to maintain the emitting condition. As a result of this, it becomes possible to sufficiently improve the plasma generation efficiency in relation to usage power.

Figure 3:
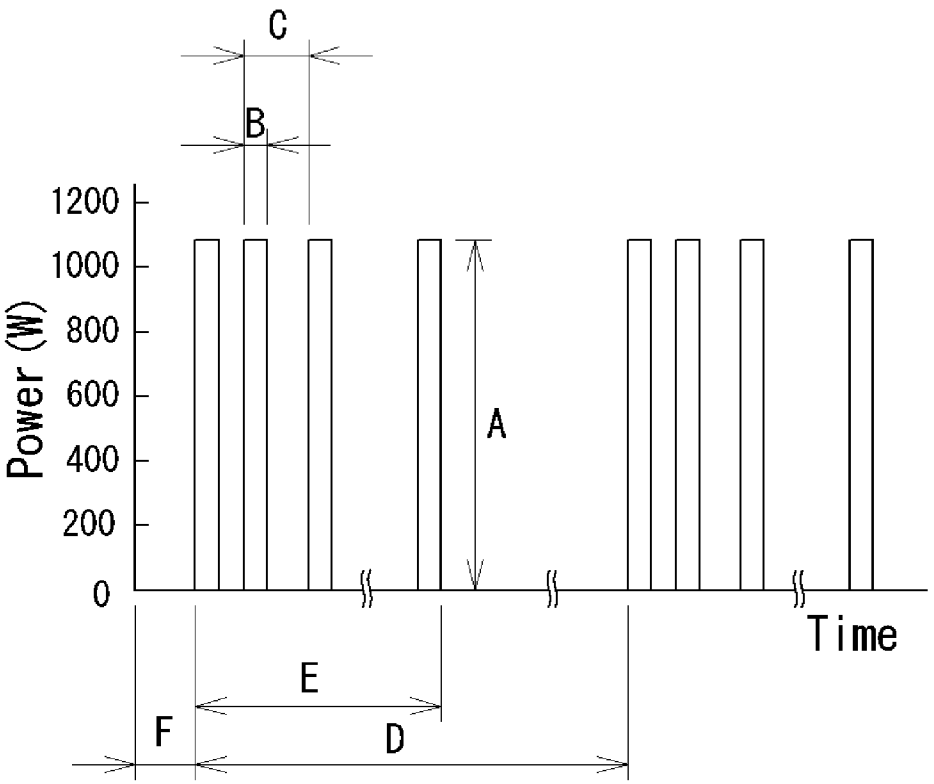
FIG. 3 is a diagram showing an oscillation pattern of an electromagnetic wave pulse by the plasma generation apparatus according to the embodiment.

After a predetermined delay time has elapsed from a time point of the discharge plasma generation, a microwave of a predetermined pulse width, pulse cycle, and duty cycle is repeatedly emitted from the electromagnetic wave emission antenna 6. FIG. 3 shows a preferable oscillation pattern of the microwave emitted from the electromagnetic wave emission antenna 6 according to the present embodiment. After a predetermined delay time F has elapsed after the spark discharge, the microwave is repeatedly emitted at a predetermined pulse width B, pulse cycle C, duty cycle, and burst pulse width E. After a predetermined time period has elapsed, similar pulses are emitted again, and this burst pulse cycle D is repeated. Here, the pulse width is intended to mean a time period during which the microwave is continuously emitted (B in FIG. 3). The pulse cycle is intended to mean a sum of ON-time of the microwave emission at the pulse width, and OFF-time of the microwave after that (C in FIG. 3). The duty cycle is intended to mean a result value of division of the pulse width by the pulse cycle. However, in a case in which the pulse width and the pulse cycle vary during the burst pulse cycle as shown in FIG. 4B, a result value of division of a total sum of the pulse width during the burst pulse cycle by the burst pulse width is employed as the duty cycle. By emitting the microwave after the elapse of a predetermined delay time from the spark discharge, it is possible to prevent wear and erosion of the discharge electrode 9, which would occur in a case in which spark discharge and microwave emission are performed simultaneously. Here, the delay time may be not limited to the above as long as the delay time is any value within the life time of the discharge plasma caused by the spark discharge, and at a timing such that the microwave energy is sufficiently absorbed to enlarge the discharge plasma. However, the delay time may be preferably from not less than 0.1 to not greater than 10 mS, more preferably from not less than 0.5 to not greater than 5.0 mS, still more preferably from not less than 0.8 to not greater than 3.0 mS, and especially preferably from not less than 1.0 to not greater than 2.0 mS. By specifying the delay time within the above described range, it becomes possible to sufficiently enlarge the discharge plasma and prevent wear and erosion of the discharge electrode 9 as well.

The pulse width may be selected as appropriate so that the plasma should further expand. Normally, the pulse width is preferably greater than or equal to 2 mS, and more preferably greater than or equal to 3 mS. An upper limit of the pulse width is, in view of reducing power consumption, preferably less than or equal to 10 mS, and more preferably less than or equal to 5 mS. The duty cycle is preferably from not less than 5 to not greater than 80%, more preferably from not less than 10 to not greater than 70%, and still more preferably from not less than 20 to not greater than 60%. By emitting the microwave of the above described pulse width and duty cycle, it becomes possible to efficiently enlarge the discharge plasma, while reducing power consumption.

Figure 4:
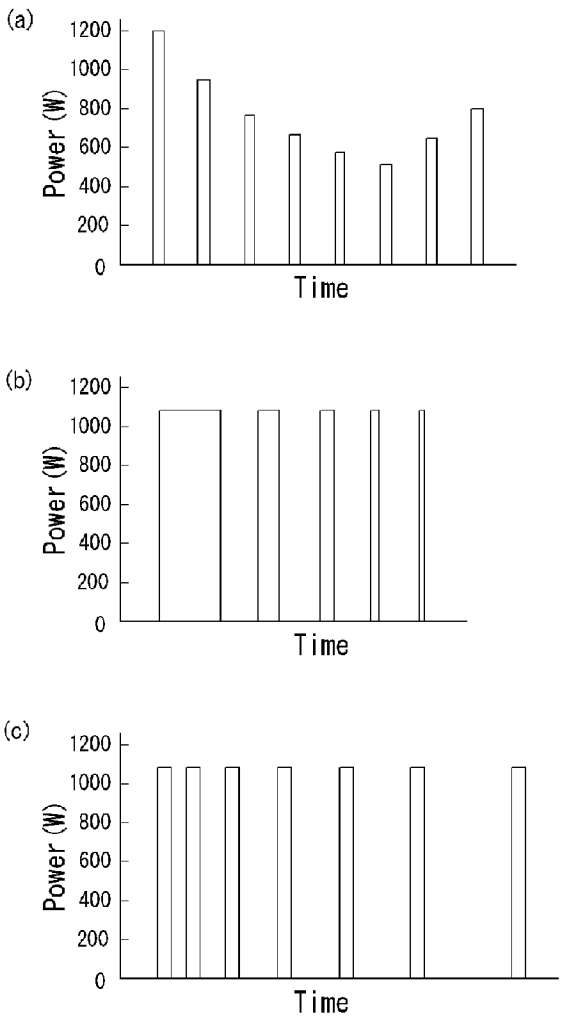
FIG. 4 is a diagram showing another example of the oscillation pattern of the electromagnetic wave pulse by the plasma generation apparatus according to the embodiment.
Figure 5:
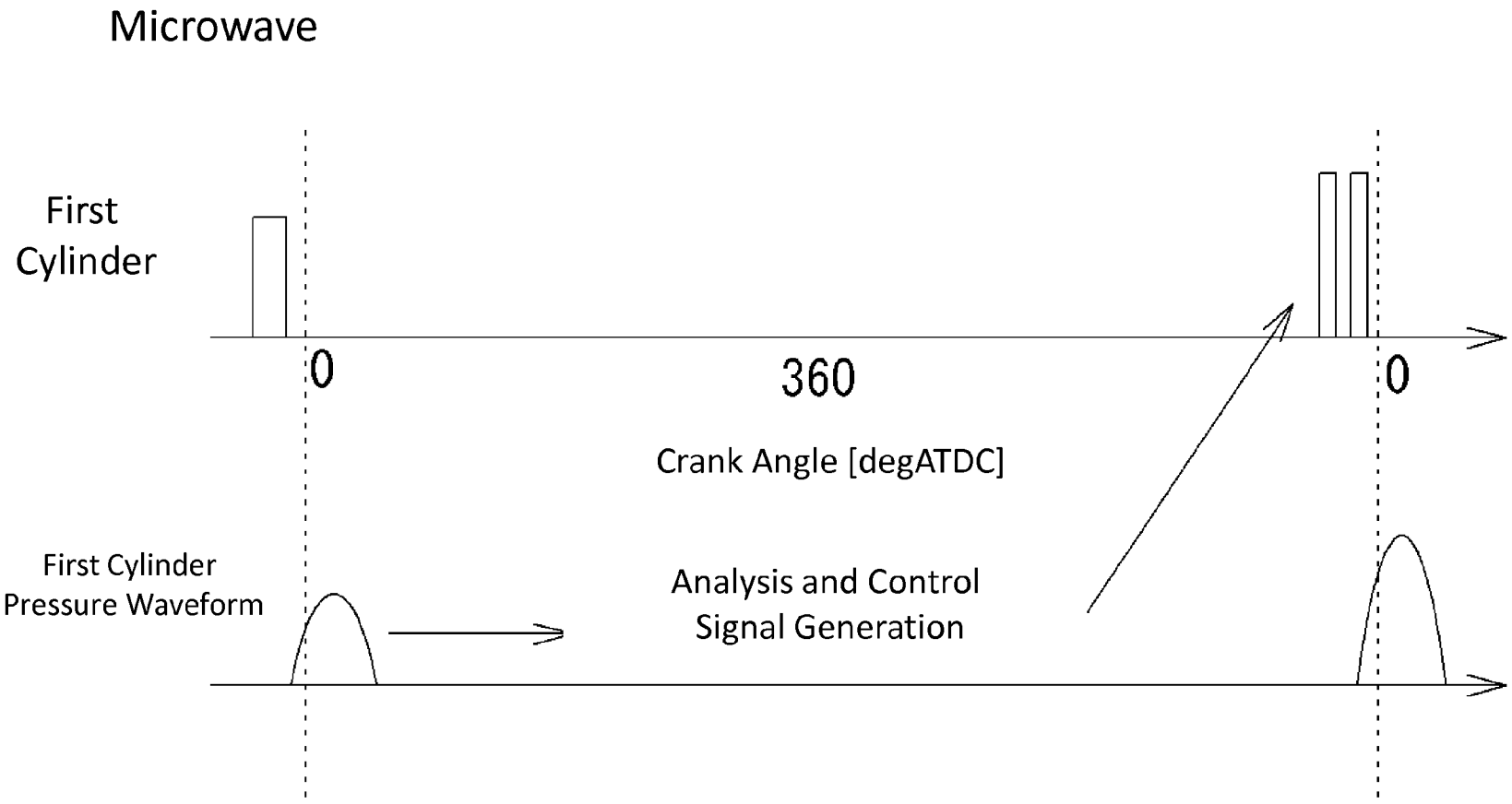
FIG. 5 is a diagram showing an example of a feedback control in a case in which the plasma generation apparatus according to the embodiment is applied to an internal combustion engine of a vehicle.

The oscillation pattern of the microwave is not limited to the above described patterns. As shown in FIG. 4, the microwave output may be varied (FIG. 4A), the pulse width may be varied (FIG. 4B), and the pulse cycle may be varied (FIG. 4C).

The plasma generation apparatus 1 according to the present embodiment may preferably be applied to an internal combustion engine such as a vehicle engine. In this case, the plasma generation apparatus according to the present invention may preferably include a table (a plasma optimization table) that optimizes the plasma in accordance with a condition of a combustion field of the internal combustion engine, correspond to ECU (Engine Control Unit) MAP control or the like, in which the engine is controlled in accordance with an operation condition of the engine, and efficiently generate radicals so that plasma intensity varies in accordance with a combustion propagation speed, thereby being controlled so as to minimize the reflected wave power.

The plasma optimization table is designed to be able to determine an optimal frequency, intensity, emission timing, emission period, and the like of the microwave using, as parameters, vehicle operation conditions such as an engine rotational speed, an engine load, a vehicle speed, a propeller shaft rotational speed, a transmission shift position, an accelerator position, an engine temperature, an outside air temperature, an outside air pressure and the like and engine operation conditions such as an ignition timing, an injection timing, an EGR (Exhaust Gas Recirculation), an intake air amount, an intake air temperature, an A/F (Air Fuel ratio) and the like.

The plasma generation apparatus 1 applied to the vehicle engine may preferably be applied to the engine during the cold start. The cold start is intended to mean starting up an internal combustion engine in a state in which the temperature of the internal combustion engine is less than or equal to the outside air temperature. In general, in order to deal with the cold start, the engine is brought into a rich fuel state, in which fuel supply amount is increased, so as to attain a sufficient air fuel ratio to start up the engine. However, during the cold start, it is common that fuel ignition failure occurs and total hydrocarbon increases. On the other hand, at the time of the cold start as described above under a control of the plasma control device 2 of the plasma generation apparatus 1, the engine operates during the cold start in a strong ignition mode, in which the microwave output and the duty cycle are maintained higher than during the time of normal operation, especially based on the engine temperature, the outside air temperature, and the A/F among the above described parameters. As a result of this, it becomes possible to completely combust the fuel in the rich fuel state during the cold start. Furthermore, by enhancing the degree of the strong ignition mode, it becomes possible to have a good cold start even in a stoichiometric state or a lean state, in which fuel supply amount is decreased.

In the plasma generation apparatus 1 applied to the internal combustion engine, the plasma control device 2 may preferably perform a control during the cold start of the internal combustion engine so as to limit fuel injection and emit the electromagnetic wave for a purpose of raising a temperature in the vicinity of the discharge device 3 of the internal combustion engine. During the cold start, by irradiating the vicinity of the discharge device 3 with the electromagnetic wave and heating residual moisture in the combustion chamber, it becomes possible to raise the temperature in the vicinity of the discharge device 3 and improve ignitability during the cold start. Although a period to limit fuel injection (a number of rotations of a starter motor in the internal combustion engine) is not limited, it may be preferably, for example, a period between 2 rotations (in a case of a 4 cylinder 4 cycle engine, a period in which one cycle is complete for every cylinder) and 4 rotations. By stopping fuel injection and only emitting the electromagnetic wave (blank shot of the microwave) during the period, it becomes possible to raise the temperature of the discharge electrode 3 and the vicinity of the discharge electrode 3 and realize a good cold start.

Furthermore, as a countermeasure for unburned gas during the cold start, the electromagnetic wave emission antenna 6 may be disposed in an exhaust manifold, and the plasma control device 2 may control so that the electromagnetic wave (microwave) should cause after-burning of the unburned gas in the exhaust manifold. As a result of this, in a case in which unburned gas remains, by supplying excess air and by way of the electromagnetic wave emitted in the exhaust manifold, it becomes possible to completely oxidize the unburned gas.

Furthermore, in the plasma generation apparatus 1 applied to the internal combustion engine, a plurality of the electromagnetic wave emission antennae 6 may be arranged in a ring-like shape and in plural (on an outer periphery of the cylinder and a circle passing through an intake port and an exhaust port), and may be controlled so that a flame should flow from the outer periphery of the cylinder toward a center of the cylinder. As a result of this, it becomes possible to reduce heat transmitted to an inner wall surface of the cylinder, and improve thermal efficiency of the internal combustion engine.

Other than those described above, as a control method of dealing with changes in the combustion field, a method may preferably be employed such that the reflected wave power is minimized by way of the feedback control of the oscillating frequency of the electromagnetic wave oscillator 10, thereby controlling so as to efficiently generate radicals at a plasma intensity maximum condition.

Advantage of Plasma Generation Apparatus According to the Present Embodiment

Since the plasma generation apparatus 1 according to the present embodiment can control the microwave pulse as described above, it is possible to reduce a waste of power and to generate plasma of intensity suitable for a purpose of use at an appropriate timing. As a result of this, it becomes possible to improve the plasma generation efficiency in relation to usage power.

INDUSTRIAL APPLICABILITY

As described above, the present invention is useful in relation to a signal processing device that processes a signal to control an engine.

EXPLANATION OF REFERENCE NUMERALS

1 Plasma Generation Apparatus
2 Plasma Control Device
3 Discharge Device
4 Electromagnetic Wave Oscillation Device
5 Distributor
6 Electromagnetic Wave Emission Antenna
7 Direct Current Power Supply
8 Ignition Coil
9 Discharge Electrode
10 Electromagnetic Wave Oscillator
11 Attenuator/Switch
12 Amplifier
13 Directional Coupler
14 Traveling Wave Power and Reflected Wave Power Detector

What is claimed is:

1. A plasma generation apparatus having an electromagnetic wave emission antenna and a discharge electrode comprising:

a plasma control device that controls generation of plasma, wherein the plasma generation apparatus is characterized in that the plasma control device causes the electromagnetic wave emission antenna to intermittently emit an electromagnetic wave by way of a drive sequence control;

wherein the plasma control device is subject to a programmed control in accordance with generation efficiency of the plasma; and wherein the generation efficiency of the plasma is represented by at least one index value selected from among a group of index values including a radical light emission amount, a temperature, an electron temperature, an electron density, and a reflected wave power.

2. A plasma generation apparatus having an electromagnetic wave emission antenna and a discharge electrode comprising:

a plasma control device that controls generation of plasma, wherein the plasma generation apparatus is characterized in that the plasma control device causes the electromagnetic wave emission antenna to intermittently emit an electromagnetic wave by way of a drive sequence control;

wherein the plasma generation apparatus is applied to an internal combustion engine; and wherein the plasma control device performs a control during a cold start of an internal combustion engine so as to limit fuel injection and emit an electromagnetic wave for raising a temperature in the vicinity of a discharge device of the internal combustion engine.

* * * * *